United States Patent [19]

Conner, Jr.

[11] 4,234,135

[45] Nov. 18, 1980

[54] WEB INSPECTION APPARATUS

[75] Inventor: William R. Conner, Jr., Shelbyville, Tenn.

[73] Assignee: Kellwood Company, St. Louis, Mo.

[21] Appl. No.: 73,996

[22] Filed: Sep. 10, 1979

[51] Int. Cl.[3] ..... B65H 19/20; B65H 17/02

[52] U.S. Cl. ..... 242/56 R; 26/70; 242/67.3 R

[58] Field of Search ..... 242/56 R, 57.1, 55 B, 242/74, 76, 67.1 D, 67.3 R; 26/70

[56] References Cited

U.S. PATENT DOCUMENTS

| | | | |
|---|---|---|---|
| 1,535,425 | 4/1925 | Little | 242/67.3 R |
| 2,567,387 | 9/1951 | Link | 242/74 X. |
| 3,299,484 | 1/1967 | Pernick | 242/67.3 R X |
| 3,942,735 | 3/1976 | Marchio | 242/56 R |
| 4,021,893 | 5/1977 | See | 242/56 R |

*Primary Examiner*—Edward J. McCarthy
*Attorney, Agent, or Firm*—Senniger, Powers, Leavitt and Roedel

[57] ABSTRACT

Apparatus for feeding a web of material from a supply thereof through an inspection area and winding the web, comprising a frame, a supply roll on the frame, a mandrel for winding the web on the frame having a gripper for gripping a leading end portion of the web, a drive for rotating the mandrel for winding the web thereon and for feeding the web through the inspection area, a panel engageable with the leading end portion of the web for backing the web fed through the inspection area, a pivotal connection mounting the panel on the frame for movement between an operative position relative to the mandrel for starting the winding of the web and a retracted position away from the mandrel, the panel being engageable with the leading end portion of the web, and cylinder units attached to the panel for moving the panel between operative and retracted positions. The gripper comprises a series of holes in the periphery of the mandrel and a vacuum pump in communication with the holes for drawing air into the mandrel. The panel when moved to operative position moves the leading end portion of the web toward engagement with the mandrel for being vacuum gripped, and when in retracted position enables rotation of the mandrel for the feeding of the web through the inspection area.

15 Claims, 5 Drawing Figures

WEB INSPECTION APPARATUS

BACKGROUND OF THE INVENTION

This invention relates to apparatus for drawing a web of material through an inspection area and winding the web, and more particularly to apparatus for drawing and winding a web such as a pattern marker in the garment industry.

This invention involves an improvement upon web inspection apparatus of the type such as shown for example in U.S. Pat. Nos. 3,942,735 and 4,021,893, generally comprising a frame, a supply roll of the web at one end of the frame, a takeup roll or mandrel at the other end of the frame, and a reviewing surface or platform supporting the web along its path of movement between the supply and takeup rolls.

In the operation of apparatus of this type, the operator manually attaches the leading end portion of the web to the takeup roll as, for example, by means of a slot in the takeup roll as shown in U.S. Pat. No. 4,021,893 or, alternatively, by means of friction tape, adhesive tape, metal clips or electrostatically charging the takeup roll as shown in U.S. Pat. No. 3,942,735. Manual attachment, however, is time-consuming and can result in misalignment (i.e., skewing) of the web on the roll which can cause improper winding of the web, particularly in the case of relatively wide webs.

SUMMARY OF THE INVENTION

Among the several objects of this invention may be noted the provision of improved apparatus for inspecting a web of material in which the leading edge portion of the web may be automatically effectively attached to a takeup roll; the provision of such apparatus in which the leading end portion of the web may be attached to the takeup roll in proper alignment (i.e., without skewing the web on the roll); the provision of such apparatus in which the web can be quickly and cleanly cut so as to enable the portion of the web wound on the takeup mandrel to be separated from the remainder of the web; and the provision of such apparatus in which the web wound on the takeup mandrel may be readily removed therefrom.

In general, the apparatus of this invention comprises a frame, means mounting a supply of the web on the frame, a mandrel for winding the web rotatably mounted on the frame having means for releasably gripping a leading end portion of the web, means for rotating the mandrel for winding the web thereon and for feeding the web through an inspection area, means for backing the web fed through the inspection area extending along the path of movement of the web between the supply and the mandrel, and means mounting the backing means on the frame for movement between an operative position relative to the mandrel for starting the winding of the web and a retracted position away from the mandrel, the backing means being engageable with the leading end portion of the web. Means is provided for moving the backing means between operative and retracted positions. The means for releasably gripping the web comprises a series of holes in the periphery of the mandrel and vacuum means in communication with the holes for drawing air into the mandrel through the holes. The backing means when moved to operative position moves the leading end portion of the web toward engagement with the mandrel for being vacuum gripped by the gripping means, and when in retracted position enables rotation of the mandrel for the feeding of the web through the inspection area.

Other objects and features will be in part apparent and in part pointed out hereinafter.

BRIEF DESCRIPTION OF THE DRAWINGS

Corresponding reference characters indicate corresponding parts throughout the several views of the drawings.

DESCRIPTION OF THE PREFERRED EMBODIMENT

Figure 1:
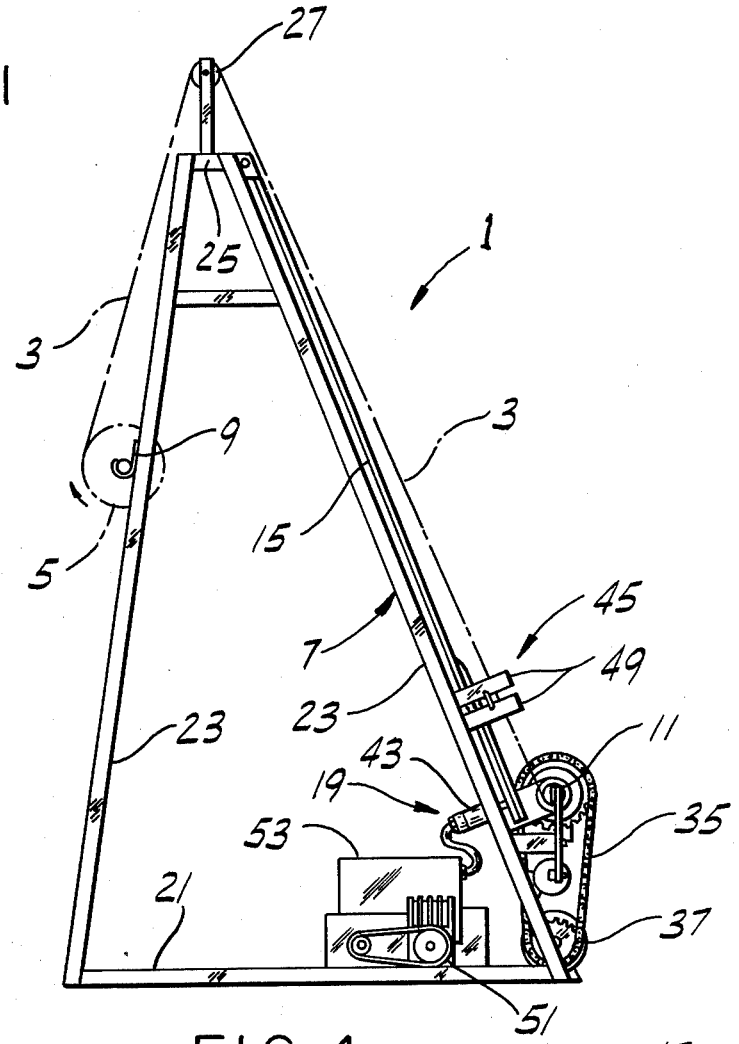
FIG. 1 is a side elevation of the apparatus of this invention showing a web being wound on the mandrel.
Figure 4:
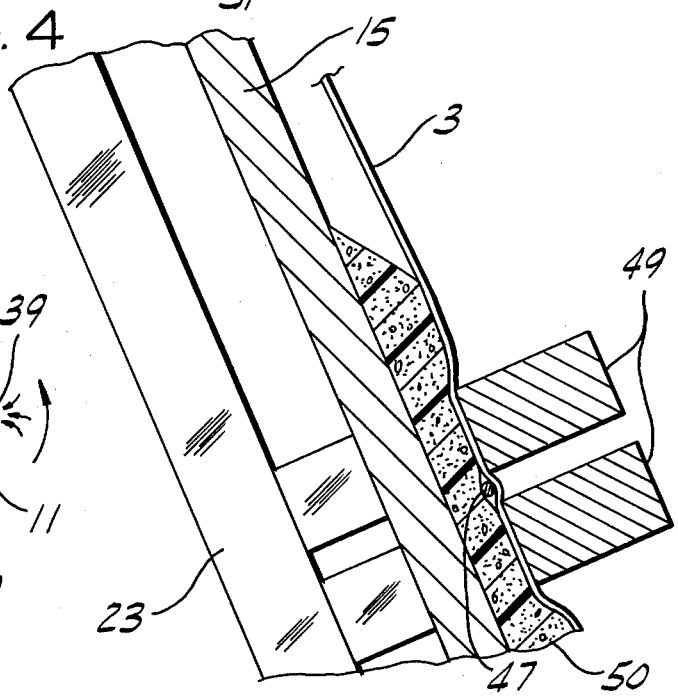
FIG. 4 is a section along line 4—4 of FIG. 2 showing the web in engagement with a cutter of this apparatus.
Figure 3:
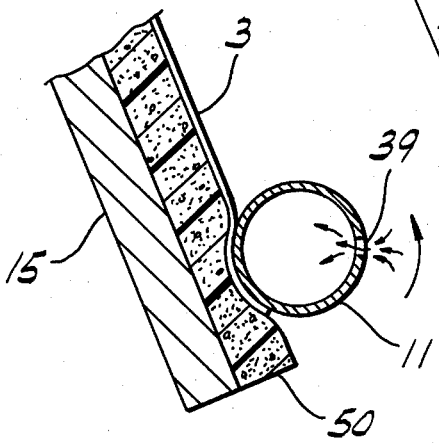
FIG. 3 is a section on line 3—3 of FIG. 2 showing the leading end portion of the web prior to being releasably gripped on the mandrel.
Figure 2:
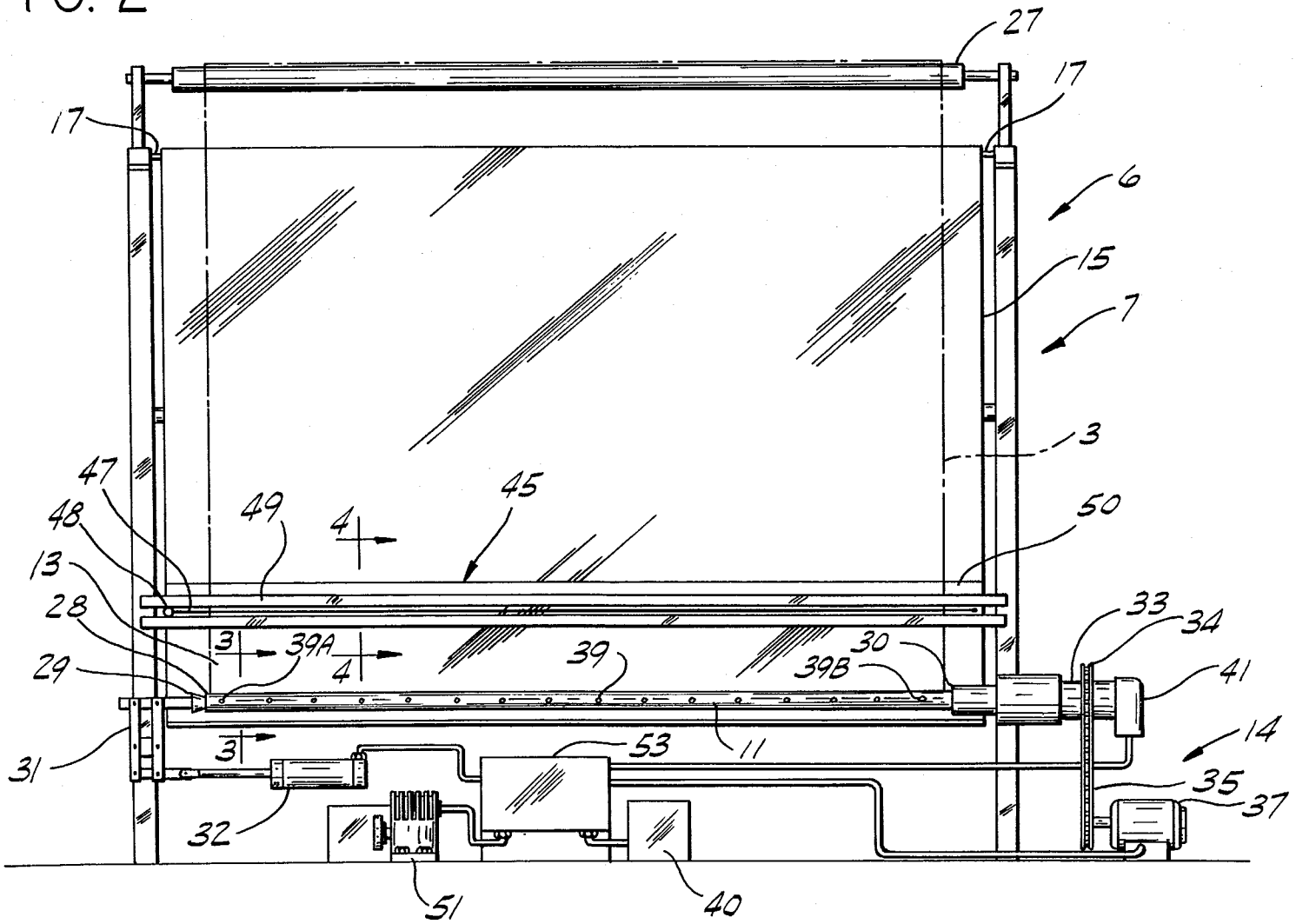
FIG. 2 is a front elevation of the apparatus showing the leading end portion of the web in engagement with the mandrel.

Referring to FIGS. 1 and 2 of the drawings, there is generally indicated at 1 apparatus of this invention for feeding a web 3 of material, such as a web of paper having computer generated cutting patterns thereon for the garment industry, the web being referred to as a "marker", from a supply 5 thereof through an inspection area at the front of the frame (i.e., to the right in FIG. 1) and generally indicated at 6 in FIG. 2. The apparatus comprises a frame 7, means 9 mounting the supply 5 on the frame and a mandrel 11 for winding the web rotatably mounted on the frame. The mandrel has means for releasably gripping a leading end portion 13 of the web and means 14 for rotating the mandrel for winding the web thereon and for feeding the web through the inspection area. At 15 is indicated means for backing the web fed through the inspection area extending along the path of movement of the web between the supply and the mandrel. Means 17 mounts the backing means on the frame for movement between an operative position relative to the mandrel for starting the winding of the web and a retracted position away from the mandrel, the backing means being engageable with the leading end portion of the web. At 19 is indicated means for moving the backing means between operative and retracted positions.

More particularly, the frame 7 comprises two forwardly extending base members 21, four frame members 23 each extending upwardly from an end of the base members, and an upper end frame member 25 having an idler roller 27 mounted thereon. The frame members 23 at the front of the frame are inclined rearwardly from bottom to top and the frame members at the rear are inclined forwardly from bottom to top, the frame thus being generally A-shaped in side elevation as shown in FIG. 1. The supply 5 is constituted by a roll mounted at the rear of the frame. The mandrel 11 is mounted at the front of the frame. The web 3 extends up from the supply roll, over the idler roller 27 and down in front of the backing means 15. The means 9 for mounting the supply roll comprises a pair of J-shaped brackets one at each side of the frame for supporting the roll shaft. A tensioning device (not shown) may be provided to maintain a substantially constant tension on the web as it is drawn through the inspection area.

The mandrel extends across the front of the frame as shown in FIG. 2 and comprises a tube of generally circular cross-section. One end 28 of the tube is engageable by a movable center or chuck 29 mounted on the frame and the other end 30 of the tube is suitably releasably secured to a rotatably mounted drive shaft.

The movable chuck 29 is carried at the upper end of a parallelogram linkage 31 pivotally mounted on the frame, a pneumatic cylinder unit 32 being connected to the linkage at its lower end. Upon retraction of the piston rod of the cylinder unit, the parallelogram linkage moves the chuck axially and laterally away from the end 28 of the mandrel to enable the web wound on the mandrel to be moved axially off the mandrel at the end 28 thereof.

Figure 5:
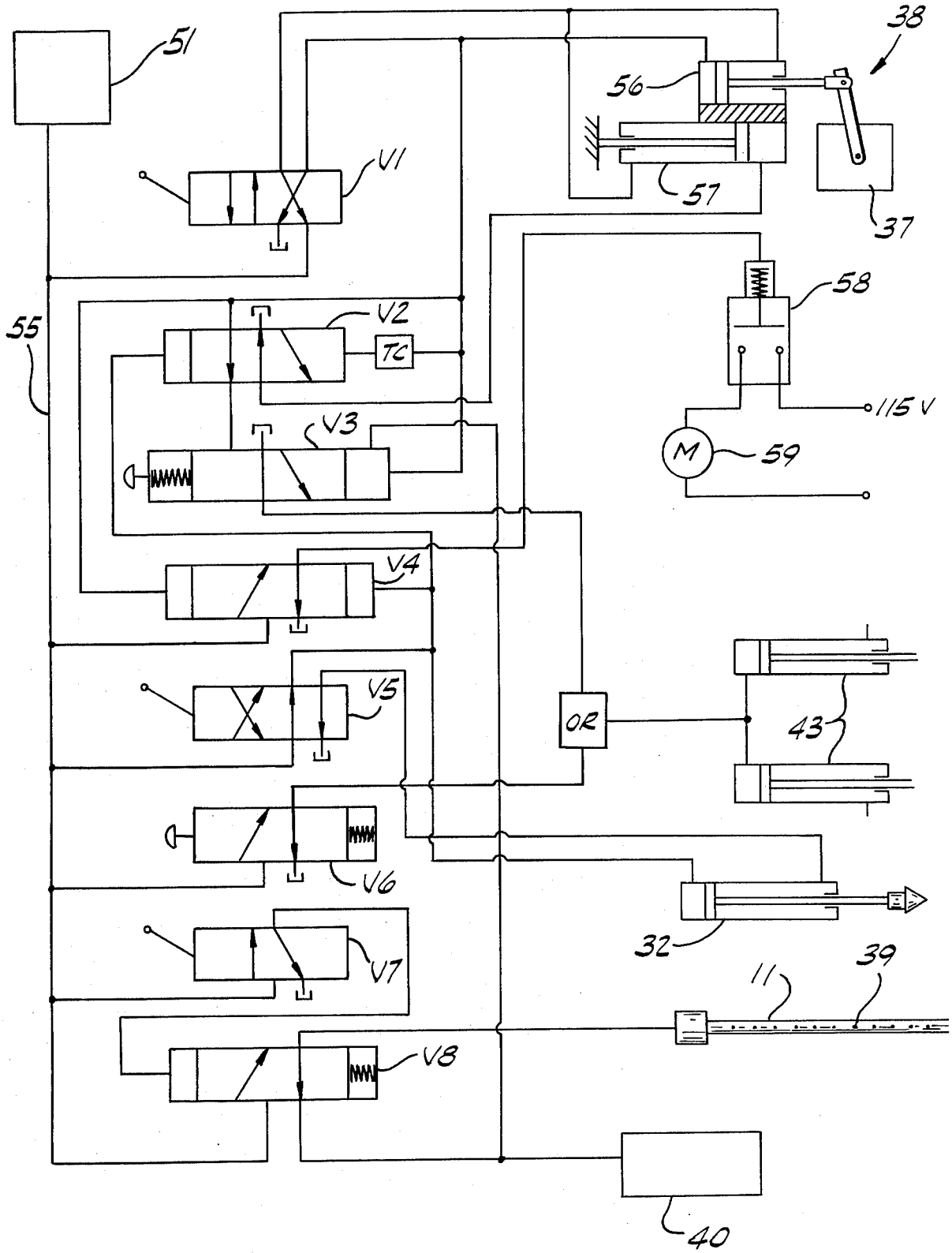
FIG. 5 is a schematic of a pneumatic control circuit of this apparatus.

The means 14 for rotating the mandrel comprises the drive shaft 33, a sprocket 34 on the shaft, a sprocket on the output shaft of a motor 37, and a chain 35 around the sprockets. The motor has control means 38 (see FIG. 5) for starting and stopping its operation and for setting its speed of operation at a low initial speed for enabling gripping of the web and a faster running speed during inspection of the web.

The means for releasably gripping the leading end portion 13 of the web comprises a series of holes 39 in the periphery of the mandrel and vacuum means such as a vacuum pump 40 in communication with the holes 39 for drawing air into the mandrel therethrough to grip the web. The air drawn in through the holes flows to the vacuum pump through the axial passage in the mandrel, a passage in the drive shaft, a rotary coupling on the drive shaft having bearing means enabling the drive shaft to rotate within the coupling in sealed relation, and a series of conduits connecting the coupling to the vacuum pump. The holes 39 are spaced at equal intervals along the mandrel with the distance between the endmost holes 39A, 39B less than the width of the web so that the sides of the web will extend slightly beyond the holes. Complete coverage of the holes 39 enables the development of sufficient vacuum for the proper operation of the apparatus as described more fully hereinafter. The mandrel 11 in one of a plurality of mandrels each having the same overall length so as to be supported by the drive shaft and chuck but having its endmost holes 39A, 39B spaced apart for a web of a predetermined width. Thus, when a web of different width is to be inspected, the mandrel then in the apparatus is removed and a second mandrel having holes of the proper spacing is installed in the apparatus.

The means 15 for backing the web may comprise a single panel at the front of the frame (as shown) or, alternatively, it may comprise a series of elements such as rollers or wires (not shown) extending across the front of the frame and in front of which the web may be drawn. For the inspection of markers the panel is preferably opaque. The means 17 mounting the backing means on the frame comprises a connection such as a pair of pivot pins at the upper end of the panel enabling pivoting movement of the panel about a horizontal axis between its operative and retracted positions. The means 19 for moving the panel between these positions comprises a pair of pneumatic cylinder units 43 each mounted on one of the frame members 23 at the front of the frame and being connected to the lower end of the panel. Upon actuation, the piston rods of the cylinder units 43 extend and pivot and panel forward toward its operative position for moving the leading end portion 13 of the web toward engagement with the mandrel for being vacuum gripped by the gripping means. The inclination of the panel is such that the panel is gravity biased to its retracted position, so that upon deactivation of the cylinder units 43 the panel will return to its retracted position and the piston rods of the cylinder units will retract. With the panel in retracted position, the mandrel is free to rotate for winding the web thereon.

To sever the length of web wound on the mandrel from the remainder of the web a cutting means 45 is provided upstream from the mandrel. This means comprises means for holding the web for cutting, and a length of line 47 such as piano wire extending across the panel behind the web, one end of the wire being secured to the panel at one side and the other end being detachably connected to the other side of the panel and having a ring 48 enabling the operator to grasp the line and pull it forward to tear the web. The means for holding the web comprises two spaced apart bars 49 extending across the front of the frame, forward of the web, the bars being engageable with the web when the panel is in operative position. To insure the engagement of the web with the mandrel 11 and with the bars 49 for the entire width of the web, the portions of the panel positioning the web in such engagement are covered with a resilient pad 50.

At 51 is indicated means such as an air compressor for supplying air under pressure to the holes in the mandrel for releasing the leading end portion of the web from the mandrel so as to enable the web wound on the mandrel to be slid axially along the mandrel for its removal from the mandrel after the web has been severed, the cylinder 32 being actuated to move the chuck away from the end of the mandrel. The air under pressure flows from the air compressor to the holes in the mandrel through a series of conduits connected to the air compressor, the rotary coupling 41, the passage in the drive shaft 33, and the axial passage in the mandrel 11.

A pneumatic control circuit is provided at 53 for programming the operation of the apparatus 1. This comprises a manifold 55 connected to the air compressor and a series of eight valves V1–V8, six of which are directly connected to the manifold and two of which receive air under pressure from another valve. The valve V1 is a manually operated valve connected to both ends of a first double-acting cylinder unit 56 of the motor control 38 for starting and stopping and controlling the low initial speed operation of the motor 37. The valve V2 is a pilot-air-operated valve having a timing cylinder TC, the valve being connected to one end of a second double-acting cylinder unit 57 of the motor control 38 for controlling the high speed operation of the motor 37. The valve V3 is a pilot-air-operated valve connected to the pair of cylinder units 43 for moving the panel 15 forward toward its operative position. The valve V3 is also connected to the vacuum pump 40, the vacuum when fully developed returning the valve V3 to its initial position for blocking the flow of air under pressure to the cylinder units 43. The valve V4 is a pilot-air-operated valve connected to a pressure actuated electrical switch 58 for energizing a motor 59 for driving the vacuum pump 40, the valve V4 being connected to valve V1 and controlled by pilot air therefrom. The valve V5 is a manually operated valve connected to the cylinder unit 32 for moving the chuck 29 into and out of engagement with the mandrel. The valve V6 is a manually operated valve connected to the cylinder unit 43 for moving the panel 15 forward toward the bars 49 for the cutting of the web. The valve V7 is a manually operated valve connected to valve V8 for controlling the operation of the valve V8. The latter is a pilot-air-operated valve connected to the vacuum pump 40 and to the mandrel 11 for controlling the operation of the means for releasably gripping the leading end portion 13 of the web.

In operation, with the panel in retracted position, the operator positions the leading end portion 13 of the web in front of the pad 50 on the panel 15. Then the operator moves the valve V1 to a position in which air under pressure is supplied to the first cylinder unit 56 for actuating the motor 37 to run at a low speed. The air under pressure from valve V1 is also supplied as pilot air to the valves V2, V3 and V4. The valve V2 is initially set to supply air under pressure to the valve V3. After a time delay determined by the timing cylinder TC, the pilot air sets the valve V2 to supply air under pressure to the second cylinder unit 57 for increasing the speed of the motor 37. The valve V3 is actuated by pilot air to supply air under pressure to the cylinder units 43 for moving the panel forward toward the mandrel. The valve V4 is actuated by pilot air to supply air under pressure to actuate the switch 58 for energizing the motor 59 driving the vacuum pump 40. The operator then moves the valve V7 to a position in which pilot air is supplied to valve V8 to actuate it to provide communication between the vacuum pump 40 and the mandrel 11. Thus, upon the operator moving valve V1 and then valve V8, the vacuum means for releasably gripping the mandrel is actuated, the mandrel is rotated at low speed, and the panel moves the leading end portion of the web toward engagement with the mandrel for being vacuum gripped by the gripping means. After a predetermined time which is sufficient to enable the leading end portion of the web to be gripped and the mandrel to rotate several turns to wrap the web thereon, sufficient vacuum develops to actuate valve V3 to depressurize the cylinders 43, thereby allowing the panel to return to its retracted position for enabling unhampered rotation of the mandrel. Thereafter, timing chamber TC operates as mentioned above to pilot the valve V2 to supply air under pressure to the second cylinder unit 57 of the motor control 38 for controlling the motor to operate at a higher running speed for feeding the web through the inspection area.

After inspecting a predetermined length of web or upon reaching the end of a marker, the operator sets the valve V1 in stop position in which air under pressure is applied to the first and second cylinder units 56 and 57 of the motor control for deenergizing the motor to stop the rotation of the mandrel. Thereafter, the operator sets valve V6 to supply air under pressure to the cylinder unit 43 to move the panel 15 forward to press the web against the cutter bars 49. Whereupon, the operator grasps the ring 48, pulls the line 47 forward to tear the web, and releases the valve V6 to depressurize the cylinders 43 for allowing the panel to move away from the cutter bars. The free end of the web wound on the mandrel is then taped or otherwise attached to the web on the mandrel. To remove the web wound on the mandrel therefrom the operator sets valve V7 to supply pilot air to the valve V8 for setting it to block communication between the vacuum pump and the mandrel 11 and to supply air under pressure to the mandrel. The operator then sets the valve V5 to supply air under pressure to the cylinder unit 32 for moving the chuck 29 away from the end of the mandrel. This enables removal of the web from the mandrel by sliding it off the free end thereof. Upon resetting valves V5 and V7 to their initial setting, apparatus is ready for drawing another predetermined length of web through the inspection area and winding it.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

What is claimed is:

1. Apparatus for feeding a web of material from a supply thereof through an inspection area and winding the web, comprising:

a frame;

means mounting the supply on the frame;

a mandrel for winding the web rotatably mounted on the frame having means for releasably gripping a leading end portion of the web;

means for rotating the mandrel for winding the web thereon and for feeding the web through the inspection area;

means for backing the web fed through the inspection area extending along the path of movement of the web between the supply and the mandrel;

means mounting the backing means on the frame for movement between an operative position relative to the mandrel for starting the winding of the web and a retracted position away from the mandrel, the backing means being engageable with the leading end portion of the web; and means for moving the backing means between operative and retracted position;

the means for releasably gripping the web of material comprising a plurality of holes in the periphery of the mandrel and vacuum means in communication with the holes for drawing air into the mandrel through the holes, the backing means when moved to operative position moving the leading end portion of the web toward engagement with the mandrel for being vacuum gripped by the gripping means, and when in retracted position enabling rotation of the mandrel for the feeding of the web through the inspection area.

2. Apparatus as set forth in claim 1 wherein the frame has a front and a rear, and wherein the supply is mounted at the rear of the frame and the backing means is mounted at the front of the frame, the web extending up from the supply, over an idler roller at the upper end of the frame and down in front of the backing means.

3. Apparatus as set forth in claim 2 wherein the front of the frame is inclined forwardly from top to bottom, the backing means comprising a panel connected at an upper end thereof to the frame for pivoting movement about a horizontal axis.

4. Apparatus as set forth in claim 2 wherein the mandrel is disposed forward of the backing means and extends across the front of the frame.

5. Apparatus as set forth in claim 2 wherein the mandrel is releasably secured at one end thereof to a drive shaft rotatably mounted on the frame.

6. Apparatus as set forth in claim 5 wherein the drive shaft has a passage therein in communication with the holes in the mandrel, and wherein the apparatus further comprises a coupling between the drive shaft and the vacuum means providing communication between the passage in the drive shaft and the vacuum means and enabling rotation of the drive shaft.

7. Apparatus as set forth in claim 6 further comprising means for providing air under pressure to the series of holes in the mandrel for releasing the leading end portion of the web so as to enable the wound web to be slid axially along the mandrel.

8. Apparatus as set forth in claim 5 further comprising a movable chuck mounted on the frame engageable with the other end of the mandrel for supporting the mandrel, and means for moving the chuck away from the mandrel to enable the web wound on the mandrel to be removed therefrom by sliding it off the mandrel at said other end..

9. Apparatus as set forth in claim 8 wherein the means for moving the chuck comprises a parallelogram linkage pivotally mounted on the frame and a cylinder unit connected to the linkage, the chuck being mounted on the linkage.

10. Apparatus as set forth in claim 1 wherein said holes are spaced at intervals along the mandrel, the distance between the endmost holes being less than the width of the web so that the sides of the leading end of the web will extend beyond the endmost holes when the web is on the mandrel.

11. Apparatus as set forth in claim 1 further comprising cutting means upstream of the mandrel for cutting the web wound on the mandrel from the remainder thereof.

12. Apparatus as set forth in claim 11 wherein the cutting means comprises a length of line extending across the backing means behind the web, one end of the line being secured to the backing means at one side thereof and the other end being detachably connected to the other side of the backing means, the line being adapted to be pulled forward to tear the web.

13. Apparatus as set forth in claim 12 wherein the cutting means comprises means for holding the web during the cutting thereof, the holding means being engageable by the web when the backing means is in operative position and guiding the line as it is pulled forward through the web.

14. Apparatus as set forth in claim 13 wherein the holding means comprises two spaced apart bars extending across the front of the frame, the line being pulled forward in the space between the bars to tear the web.

15. Apparatus as set forth in claim 14 wherein the portions of the backing means positioning the web in engagement with the mandrel and said bars are covered with a resilient, deformable material, the material ensuring the engagement of the web with the mandrel and bars for the entire width of the web.

* * * * *